US005641281A

United States Patent [19]

Russell et al.

[11] Patent Number: 5,641,281

[45] Date of Patent: Jun. 24, 1997

[54] LUBRICATING MEANS FOR A GEAR PUMP

[75] Inventors: Charles R. Russell; Fernie E. Williams, both of Charlotte, N.C.

[73] Assignee: LCI Corporation, Charlotte, N.C.

[21] Appl. No.: 560,736

[22] Filed: Nov. 20, 1995

[51] Int. Cl.[6] ..... F04C 2/18

[52] U.S. Cl. ..... 418/102; 418/131; 418/206.7

[58] Field of Search ..... 418/131, 132, 418/102, 206.7

[56] References Cited

U.S. PATENT DOCUMENTS

| | | | |
|---|---|---|---|
| 2,276,107 | 3/1942 | Simons | 418/102 |
| 2,471,149 | 5/1949 | Girz | 418/102 |
| 2,756,684 | 7/1956 | Renzo | 418/102 |
| 2,816,511 | 12/1957 | Korkowski et al. | 418/102 |
| 2,853,952 | 9/1958 | Aspelin | 418/132 |
| 3,447,472 | 6/1969 | Hodges et al. | 418/102 |
| 3,482,524 | 12/1969 | Marietta | 418/132 |
| 4,090,820 | 5/1978 | Teruyama | 418/102 |
| 4,160,630 | 7/1979 | Wynn | 418/102 |
| 4,265,602 | 5/1981 | Teruyama | 418/102 |
| 4,389,170 | 6/1983 | Hayashi | 418/102 |
| 4,395,207 | 7/1983 | Manttari et al. | 418/102 |
| 4,470,776 | 9/1984 | Kostek et al. | 418/102 |
| 4,629,405 | 12/1986 | Hidasi et al. | 418/102 |
| 4,859,161 | 8/1989 | Teruyama et al. | 418/102 |
| 4,927,343 | 5/1990 | Lonsberry | 418/102 |
| 5,120,206 | 6/1992 | Greenstreet et al. | 418/102 |

FOREIGN PATENT DOCUMENTS

| | | | |
|---|---|---|---|
| 4325785 | 11/1992 | Japan | 418/102 |
| 322778 | 12/1929 | United Kingdom | 418/102 |

*Primary Examiner*—John J. Vrablik

*Attorney, Agent, or Firm*—Shefte, Pinckney & Sawyer

[57] ABSTRACT

An improved self-lubricating bearing arrangement for gear pumps utilizes a system of material feed channels and reservoir pockets to divert a portion of the material being pumped from the pressure side of the intermeshing gears to lubricate the gear-supporting shafts within the bearing arrangement. At each gear shaft, a linear material feed channel is formed in the radial face of the bearing between a pressure relief recess and an axial opening supporting the shaft and a parabolic reservoir pocket is formed within the bearing opening adjacent the shaft to apply diverted polymer to the shaft. Each material feed channel and reservoir pocket is polished to a mirror finish to minimize any tendency of suspended additives in the polymer from adhering to or collecting within the channels or pockets, thereby to prevent unusual or localized wearing of the gear shafts.

17 Claims, 5 Drawing Sheets

LUBRICATING MEANS FOR A GEAR PUMP

BACKGROUND OF THE INVENTION

The present invention relates generally to gear pumps and, more particularly, to a novel improved means for self-lubricating the gear shafts of the pump utilizing the material being pumped, typically a molten viscous thermoplastic material.

Gear pumps are commonly utilized in thermoplastic extrusion systems and other similar applications to provide a positive displacement means of pressurized metered conveyance of molten thermoplastic material. One common application is to interpose a gear pump between the output end of a thermoplastic extruder and the input to an extrusion die to provide a constant volumetric rate of material pumping through the die. It is not uncommon for the meshing gears in such pumps to be driven at significant rotational speeds, whereby proper lubrication of the gear-supporting shafts in the gear pump housing is critical to maximizing the service life of the gear pump. Perhaps the most common means of lubricating the gear shafts is to provide bearings which support the opposite ends of each gear shaft and to form such bearings with a system of channels or grooves to permit a small quantity of the thermoplastic material being pumped to progressively enter the annular space between each shaft and its supposing bearing. The molten viscous character of the thermoplastic material provides a quite suitable form of lubrication and, advantageously, avoids the necessity of providing any independent means of lubrication. Various examples of such self-lubricating gear pumps are found in the prior art, such as U.S. Pat. Nos. 2,276,107; 2,816,511; 2,756,684; 2,471,149; 3,447,472; 4,090,820; 4,160,630; 4,265,602; 4,395,207; 4,470,776; 4,629,405; 4,859,161; 4,927,343; and 5,120,206.

One problem which is sometimes encountered in such self-lubricating gear pumps is premature failure of the pump due to excessive wearing of the gear shafts. While such failures are relatively rare in many thermoplastic pumping applications, it has been discovered that a higher incidence of such pump failures occurs when the material being pumped is a so-called "filled" material, i.e., having a process additive suspended in the thermoplastic polymer. For example, it is quite common in the thermoplastic extrusion of polyester to suspend a small proportion of antimony in the polymer, typically no more than about one percent by weight. Upon inspection of gear pumps which have failed in polyester extrusion applications, it has recently been observed that a significant concentration of antimony had collected in the lubrication grooves formed in the pump bearings. The gear shafts in such pumps also exhibited ring-like wear points annularly about the shafts. It therefore has been theorized that a significant contributing cause to the failure of such pumps has been a tendency of the antimony additive to adhere to the surfaces within the lubrication channels.

SUMMARY OF THE INVENTION

It is accordingly a principal object of the present invention to provide an improved means for self-lubricating the gear shafts of a gear pump to prevent or at least minimize any adhesion, other accumulation, or stagnation of pumped material within the shaft-supporting bearings, thereby to avoid premature shaft wear and potential gear pump failure.

Essentially, gear pumps to which the present invention is applicable have a housing defining a pump cavity, a pair of intermeshing toothed gears rotatably disposed within the pump cavity, each gear having a mounting shaft extending axially therefrom, and a bearing means for rotatably supporting the gear shafts. The bearing means has a radial face disposed in facing relation to the gears and a pair of axial openings for rotatably receiving the gear shafts. According to the present invention, the bearing means is self-lubricating by means of a system of material feed channels and material reservoir pockets which serve to divert a portion of the material being pumped from the pump cavity into the axial openings of the bearing means. More particularly, at each axial opening in the bearing means, a material feed channel is formed in the radial face of the bearing means generally radially with respect to the associated axial opening and a material reservoir pocket is formed within the respective axial opening in communication with the feed channel. As material is pumped by driven intermeshing rotation of the gears, a portion of the pumped material enters the feed channels and progresses therefrom into the respective reservoir pockets to be applied progressively to the annular periphery of the associated gear shaft during its rotation. Advantageously, the material feed channels and the material reservoir pockets have smoothly polished surfaces, preferably polished to a mirror-like finish, in order to resist accumulation of material deposits and thereby to prevent wearing of the gear shafts.

Preferably, the bearing means is formed with a pressure relief recess axially adjacent the gears at the pressure side thereof immediately radially adjacent the location at which the gears mesh with one another and is configured to be disposed axially adjacent the teeth and the intervening material receiving spaces between the teeth so as to permit material captured between the gear teeth to escape as the gears begin to mesh. According to the present invention, each material feed channel extends from the pressure relief recess to the respectively associated material reservoir pocket so that the material receiving channels are disposed axially adjacent substantially only the hub portions of the gears, whereby the gear teeth do not tend to pump the material out of the feed channels. Preferably, the material feed channels are substantially linear and are generally aligned with one another.

Each material reservoir pocket is preferably of a parabolic shape configured to taper narrowingly both axially and radially relative to its respective axial opening in the bearing means from an entrance end of the pocket communicating with the respective material feed channel.

DETAILED DESCRIPTION OF THE PREFERRED EMBODIMENT

Figure 1:
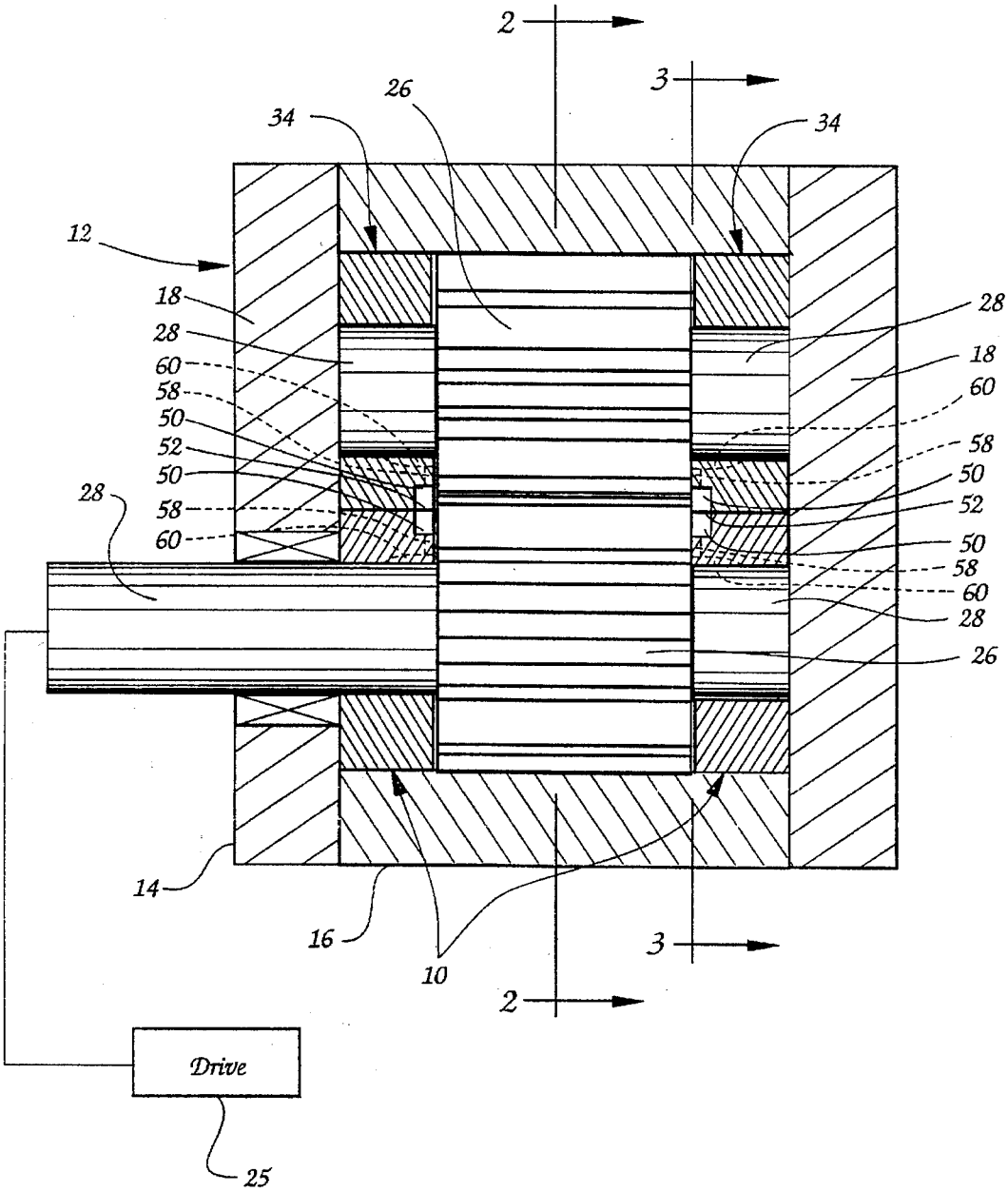
FIG. 1 is a cross-sectional view taken through the gear axes of a gear pump having a self-lubricating bearing means in accordance with the preferred embodiment of the present invention.
Figure 2:
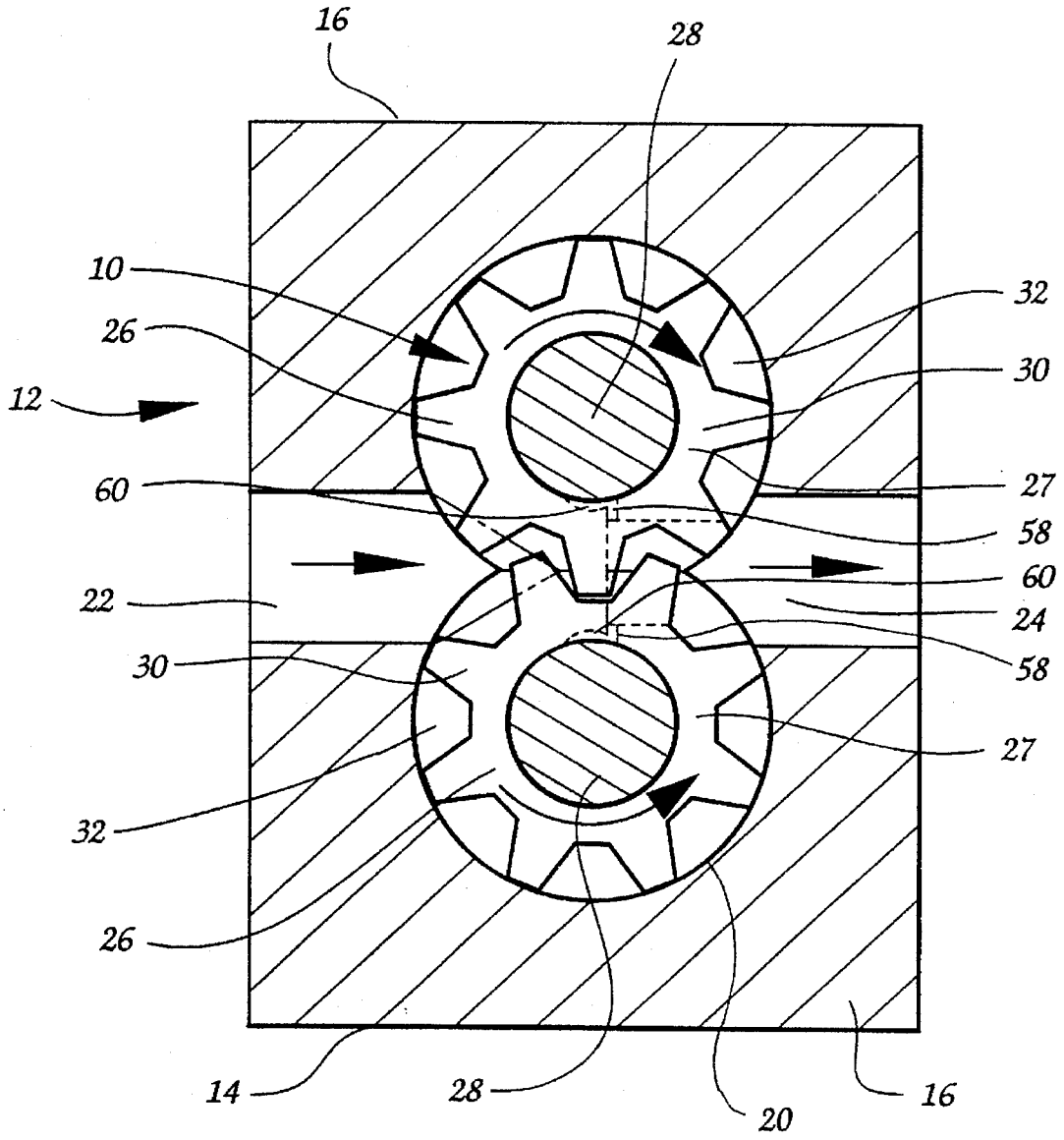
FIG. 2 is a vertical cross-sectional view taken radially through the gears of the gear pump of FIG. 1 along line 2—2 thereof.
Figure 3:
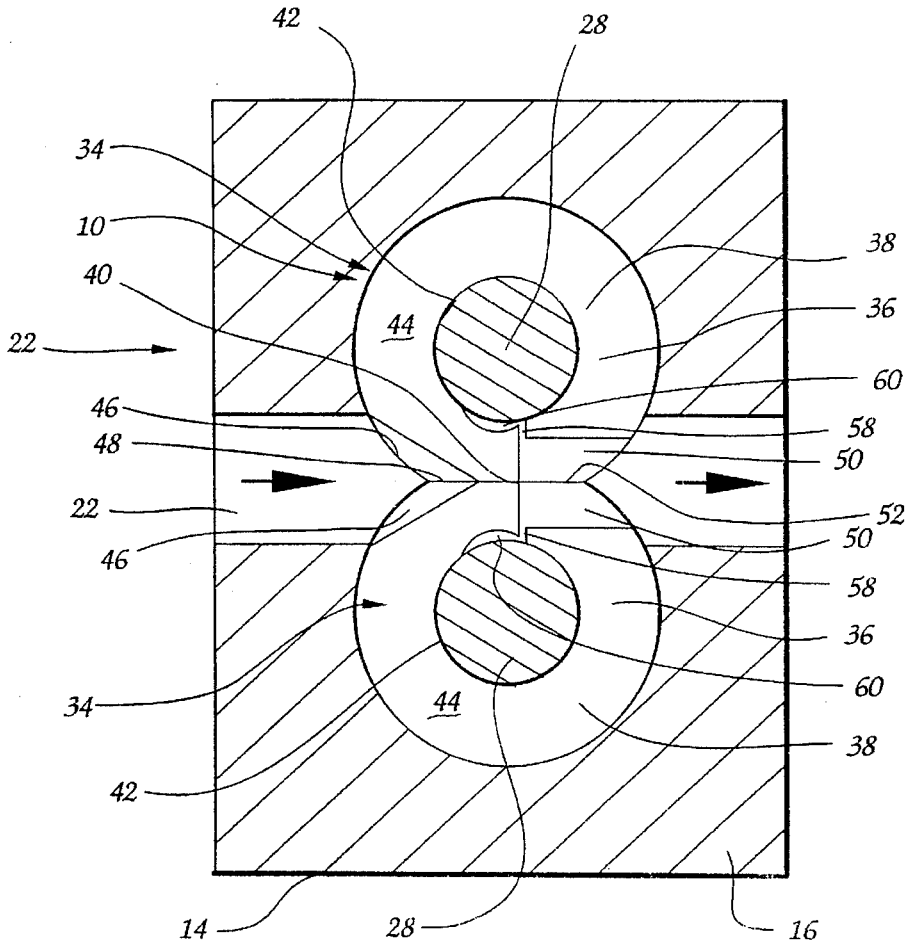
FIG. 3 is another cross-sectional view taken radially through the gear pump of FIG. 1 along line 3—3 thereof between the abutting faces of the meshing gears and the bearing assembly at one side of the gear pump, thereby showing the bearing assembly in elevation.

Referring now to the accompanying drawings and initially to FIGS. 1–3, a self-lubricating gear pump bearing means in accordance with the preferred embodiment of the present invention is broadly indicated at 10 in a gear pump 12 of otherwise conventional construction. The gear pump 12 basically includes a substantially enclosed housing 14 having a housing shell 16 and opposed end walls 18 collectively defining an interior pump cavity 20 into which a material input port 22 and a material discharge port 24 open oppositely through the housing shell 16. A pair of toothed gears 26 are mounted within the cavity 20 in meshing engagement on two parallel shafts 28 rotatably journaled in the bearing means 10, one shaft 28 being elongated to extend outwardly through the housing 14 to be connected to a suitable motor or other drive, shown only schematically at 25. As depicted in FIG. 2, the gears 26 are thereby driven in a forward direction, indicated by the directional arrows, to convey molten viscous polymeric material from the input port 22 to the discharge port 24 by capturing and conveying such material in the spaces 32 between the teeth 30 of the gears 26. In this manner, the operation of the gear pump 12 creates a suction force on polymeric material entering the input port 22 to draw the material into the gear spaces 32 and pressurizes the material upon release from the spaces 32 to positively pump the material into and through the discharge port 24.

The bearing means 10 of the present invention is preferably embodied as two bearing assemblies 34 mounted within the housing shell 16 in opposed spaced-apart facing relation to one another wherein the bearing assemblies 34 are in face abutment with the opposite axial ends of the gears 26. Each bearing assembly 34 is comprised of two mated bearings 36 each of which receives one respective end of one respective gear shall 28. Each bearing 36 has an annular body 38 having a flattened peripheral surface 40 at one circumferential side for assembled abutment with the associated mating bearing 36, a central cylindrical axial bore 42 for rotationally receiving the associated end of the respective gear shaft 28, and a flat planar inward radial face 44 for facing abutment with the associated gear 26. Each bearing 36 is additionally formed with a flattened surface 46 extending angularly between the inward radial face 44 and the flattened peripheral surface 40 at the circumferential side of the bearing 36 facing the material input port 22, whereby the respective angular surfaces 46 of each mated pair of bearings 36 cooperate in their assembled relationship to form a V-shaped recess 48 at the suction side of the gears 26 to facilitate suction drawing of the incoming polymeric material into the spaces 32 between the gear teeth 30 to ensure that each gear space 32 is fully occupied with the material. At the opposite circumferential side of each bearing 36, the juncture between the flattened peripheral surface 40 and the inwardly radial face 44 is formed with a rectangular recess 50, the two recesses 50 of each mated pair of bearings 36 cooperating to form a pressure relief recess 52 opening toward the pressure side of the gears 26 to provide space for the pressurized polymeric material to escape from the gear spaces 32 at the location at which the gear teeth 30 begin to mesh with one another.

As thus far described, the configuration and manner of operation of the gear pump 12 is essentially conventional. As mentioned above, it is further conventional in gear pumps of this basic type to form the bearings 36 with appropriate channels by which a portion of the polymeric material being pumped is caused to flow into the central bore 42 of each bearing 36 so as to be applied to the outer peripheral surface of the rotating gear shafts 28, thereby achieving a progressively replenished lubricating film of the polymeric material in the annular space between each bearing 36 and the gear shaft 28 supported therein.

Figures 4, 5, 6:
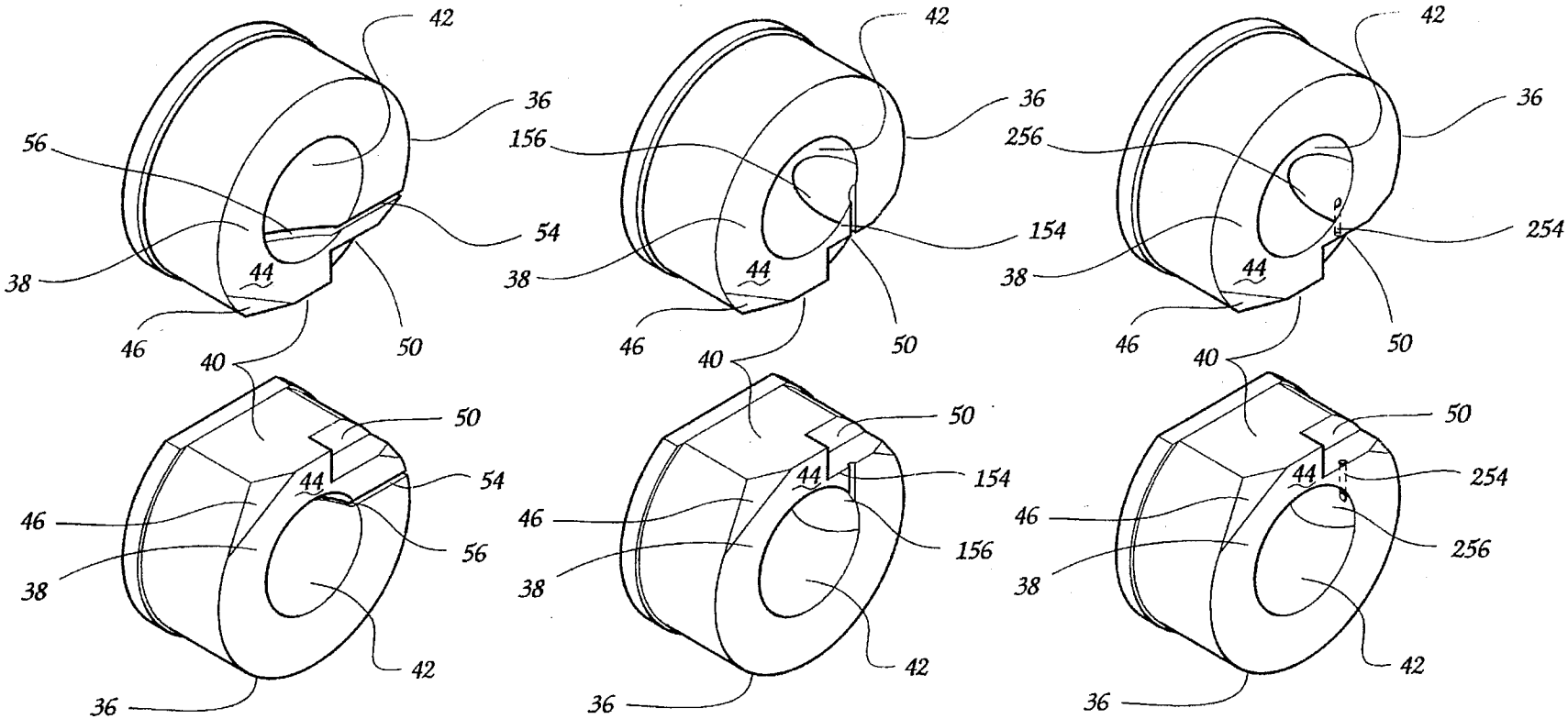
Fig. 6 Prior Art
Fig. 5 Prior Art
Fig. 4 Prior Art
FIGS. 4–6 are exploded perspective views of conventional self-lubricating prior art bearing assemblies of the type used in conventional gear pumps.

By way of illustrative example, the bearings illustrated in FIGS. 4–6 are representative of several types of self-lubricating channel configurations used in conventional gear pumps. As depicted in FIG. 4, the inward radial face 44 of each bearing 36 is formed with a linear channel 54 of a semicircular cross-sectional configuration extending from the pressure side of the bearing 36 to the central bore 42 in essentially tangential relation to the bore 42, whereat the linear channel 54 merges into another semicircular recess 56 formed in the inward circumferential surface of the bearing 36 surrounding the axial bore 42 and extending arcuately in the direction in which the associated gear shaft 28 rotates. While this form of self-lubricating channel configuration provides reasonably satisfactory performance in many polymeric pumping applications, it has been found that, in applications wherein a "filled" polymeric material carrying a suspended process additive is being pumped (e.g., the pumping of molten polyester carrying antimony in suspension, or a like form of metallic or non-metallic suspension particles), a tendency exists over time for the particles in suspension to collect in a concentrated form within the arcuate channel 56, creating a propensity for isolated wearing of the gear shaft 28 and ultimate failure of the gear pump 12.

FIGS. 5 and 6 depict similar conventional forms of self-lubricating bearing assemblies which have been utilized in existing gear pumps. Essentially, these bearing assemblies differ from that of FIG. 4 in that the tangential feed channel is oriented to extend from the rectangular recess 50 of each bearing 36 and the interior polymer-applying recess is formed in a parabolic shape. Thus, in the bearing assembly of FIG. 5, semicircular polymer feed channel 154 is formed in the inward radial face 44 of each bearing 36 to extend from the rectangular recess 50 tangentially to the central bore 42 whereat each feed channel 154 opens into a parabolic recess 156 formed in the inward circumferential surface of the bearing 36. The bearing assembly of FIG. 6 is substantially the same except that the feed channel is formed as a bore 254 extending internally through the body 38 of each bearing 36 to open tangentially into the interior parabolic recess 256.

Figure 8:
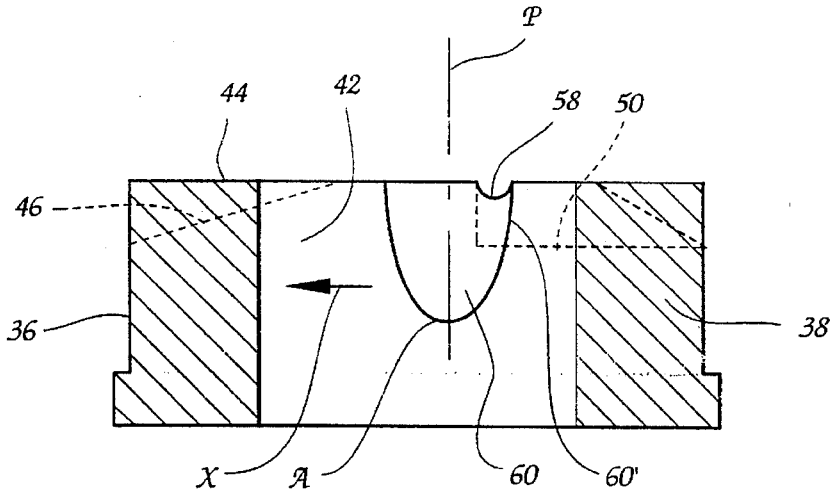
FIG. 8 is a radial cross-sectional view of one bearing component of the gear pump of FIG. 1, taken along line 8—8 of FIG. 7.
Figure 7:
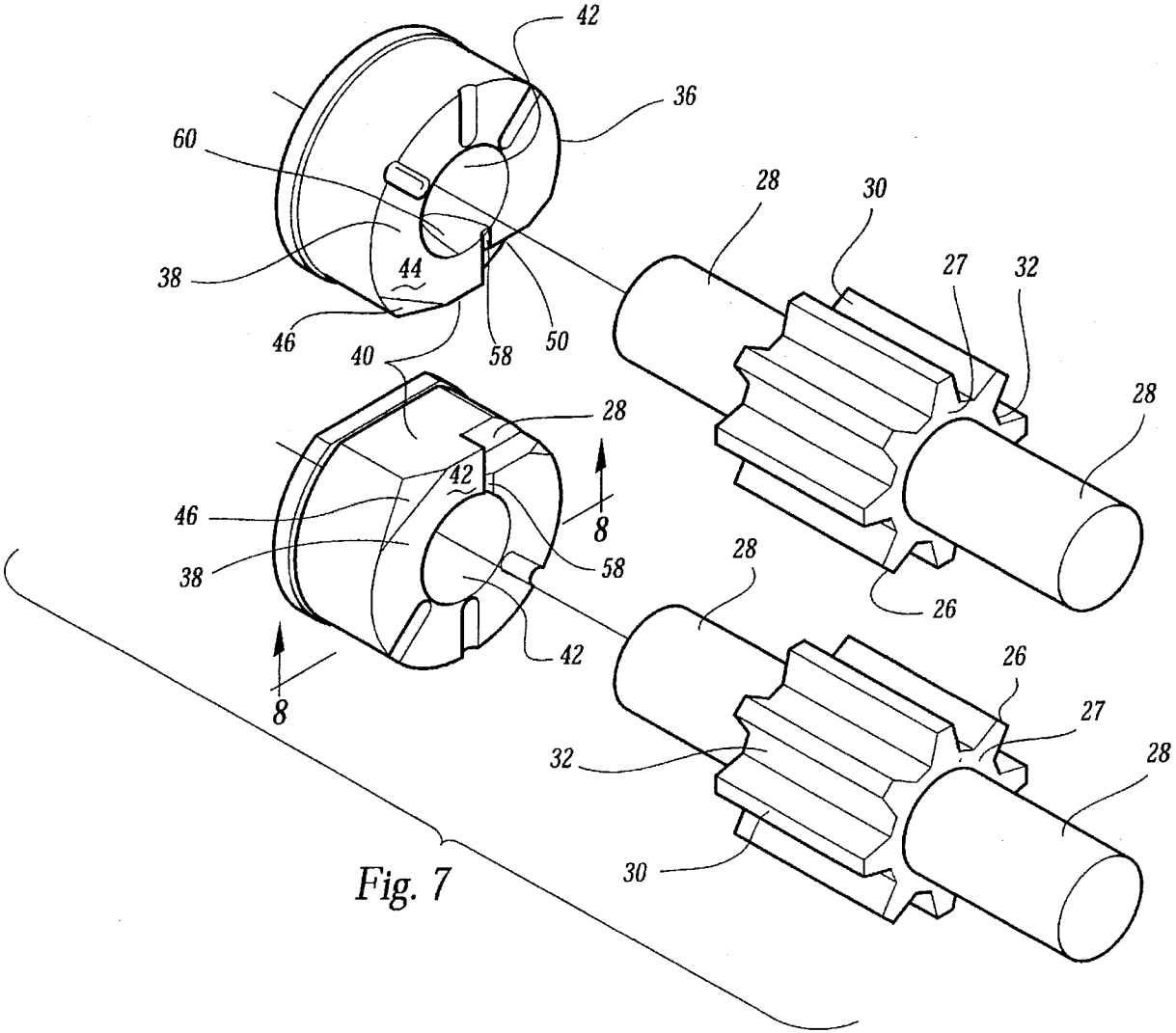
FIG. 7 is a partial perspective view showing the gears and one side bearing assembly of the gear pump of FIG. 1 in exploded form.

As best depicted in FIGS. 7 and 8, the bearing means 10 of the present invention provides a novel self-lubricating channel arrangement which substantially overcomes the above-described difficulties encountered with conventional gear pump bearings such as illustrated in FIGS. 4–6. Specifically, in accordance with the present invention, the inward radial face 44 of each bearing 36 is formed with a recessed linear channel 58 extending from the inwardmost corner of the rectangular recess 50 to the central bore 42 in a generally radial orientation with respect to the bore 42 and the inwardly facing circumferential surface of the bearing body 38 is formed with a recessed reservoir pocket 60 of a substantially parabolic shape communicating with the channel 58. As shown in FIG. 8, the parabolic pocket 60 has its widest dimension circumferentially of the central bore 42 at the annular edge between the bore 42 and the inward radial face 44 at which the pocket 60 communicates with the channel 58, from which the pocket 60 extends at a progressively narrowing widthwise dimension (i.e., circumferentially of the bore 42) symmetrically with respect to a parabolic axis P in axially parallel relation to the central axis of the bore 42, terminating at an arcuately curving parabolic apex A. The pocket 60 is also of a progressively tapering depthwise dimension, ie., radially with respect to the central bore 42, being of the greatest depthwise dimension adjacent the parabolic axis P at the edge between the pocket 60 and the inward radial face 44 of the bearing 36, from which the depthwise dimension of the pocket 60 gradually reduces in both widthwise and lengthwise extents, i.e., both circumferentially and axially with respect to the central bore 42. The pocket 60 is disposed to communicate with the channel 58 at the circumferential trailing edge 60' relative to the direction of gear rotation indicated by the directional arrow X in FIG. 8. In accordance with one particular aspect of the present invention, both the channel 58 and the pocket 60 are highly polished to a mirror-like surface finish.

Accordingly, the operation of the present invention may thus be understood. As the gears 26 are driven in normal ongoing operation of the gear pump 12, a portion of the pressurized polymeric material escaping into the relief recesses 52 is forced into each channel 58 and therefrom fills each reservoir pocket 60 to progressively apply a thin lubricating film of the polymeric material to the circumferential peripheries of the rotating gear shafts 28, thereby to lubricate rotation of the gears 26 and shafts 28. Importantly, because the material feed channels 58 open into the pressure relief recesses 52, the feed channels 58 are of a substantially shorter length in comparison to conventional bearings, such as the channels 54,154,254 shown in FIGS. 4–6, whereby the entire extent of each feed channel 58 is disposed directly axially alongside the hub portion 27 of the respective gears 26 with no extent of the channels 58 axially adjacent the gear teeth 30 and intervening spaces 32. In this manner, any tendency of the intermeshing action of the gear teeth 30 to create a pumping action drawing the lubricating material radially outwardly through the feed channels 58 which may occur in utilizing conventional bearings such as shown in FIGS. 4–6, is substantially minimized or almost totally eliminated, thereby ensuring an adequate supply of lubricating polymer into the annular spaces between the bearings 36 and the gear shafts 28. Furthermore, the mirror-polishing of the feed channels 58 and reservoir pockets 60, together with the tapered parabolic configuration of the pockets 60, serve both to maintain dynamic lubricating flow of the polymeric material within the channels and pockets 58,60 against any potential for the material to stagnate therewithin, and to minimize any potential tendency of additives or other matter in suspension within the polymer to adhere to or collect on the surfaces of the channels and pockets 58,60. In this manner, the self-lubricating bearing means of the present invention is substantially effective to prevent conditions which may tend to produce accumulations of additives within the channels or pockets 58,60 and, in turn, to eliminate potential for unusual or localized wearing of the gear shafts 28 and attendant premature failures of the gear pump.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a gear pump having a housing defining a pump cavity, a pair of intermeshing toothed gears rotatably disposed within the pump cavity, each gear having a mounting shaft extending axially therefrom, and bearing means for rotatably supporting the gear shafts, the bearing means having a pair of axial openings for rotatably receiving the gear shafts, the bearing means including means for lubricating the gear shafts by diverting a portion of a material being pumped from the pump cavity into the axial openings of the bearing means, the improvement wherein the lubricating means comprises, for each axial opening in the bearing means, a material flow conduit formed in the bearing means for directing the pumped material to be applied progressively to the gear shaft during rotation thereof, the conduit having a surface comprising a mirrored finish for resisting accumulation of material deposits, thereby to prevent wearing of the gear shafts.

2. The improved lubricating means for a gear pump according to claim 1, wherein each material flow conduit comprises a recess formed in the respective axial opening for receiving the pumped material.

3. The improved lubricating means for a gear pump according to claim 2, wherein each recess comprises a material reservoir pocket.

4. The improved lubricating means for a gear pump according to claim 3, wherein each material reservoir pocket is parabolic in shape and configured to taper narrowingly both axially and radially relative to the respective axial opening in the bearing means from an entrance end of the pocket adjacent the respective gear.

5. The improved lubricating means for a gear pump according to claim 1, wherein each material flow conduit comprises a material feed channel formed in the bearing means.

6. The improved lubricating means for a gear pump according to claim 5, wherein the housing defines a material input port at a suction side of the gears and a material discharge port at a pressure side of the gears, and the material feed channels are disposed at the pressure side of the gears.

7. The improved lubricating means for a gear pump according to claim 6, wherein the bearing means has a pressure relief recess formed therein axially adjacent the gears at the pressure side thereof immediately radially adjacent the location at which the gears mesh with one another for permitting material captured within the teeth of the gears to escape as the gears begin to mesh, each material feed channel extending between the pressure relief recess and the respective axial opening.

8. The improved lubricating means for a gear pump according to claim 7, wherein each gear has a central hub portion from which the teeth of the gear extend radially outwardly at circumferential spacings to define material receiving spaces therebetween, the pressure relief recess is configured to be disposed axially adjacent the teeth and intervening material receiving spaces, and the material feed channels are disposed axially adjacent substantially only the respective hub portions of the gears.

9. The improved lubricating means for a gear pump according to claim 7, wherein the material feed channels are substantially linear and extend generally radially with respect to their respective axial openings in general alignment with one another.

10. The improved lubricating means for a gear pump according to claim 9, wherein the material feed channels are substantially semicircular in cross-section.

11. In a gear pump having a housing defining a pump cavity, a pair of intermeshing toothed gears rotatably disposed within the pump cavity, each gear having a mounting shaft extending axially therefrom, and bearing means for rotatably supporting the gear shafts, the bearing means having a radial face disposed in facing relation to the gears and a pair of axial openings for rotatably receiving the gear shafts, the bearing means including means for lubricating the gear shafts by diverting a portion of a material being pumped from the pump cavity into the axial openings of the bearing means, the improvement wherein the lubricating means comprises, for each axial opening in the bearing means, a material feed channel formed in the radial face of the bearing means generally radially with respect to the respective axial opening and a material reservoir pocket formed within the respective axial opening in communication with the respective feed channel for receiving therefrom the pumped material to be applied progressively to the gear shaft during rotation thereof, the material feed channel and the material reservoir pocket having smoothly polished surfaces comprising a mirrored finish for resisting accumulation of material deposits, thereby to prevent wearing of the gear shafts.

12. The improved lubricating means for a gear pump according to claim 11, wherein the housing defines a material input port at a suction side of the gears and a material discharge port at a pressure side of the gears, and the material feed channels are disposed at the pressure side of the gears.

13. The improved lubricating means for a gear pump according to claim 12, wherein the bearing means has a pressure relief recess formed therein axially adjacent the gears at the pressure side thereof immediately radially adjacent the location at which the gears mesh with one another for permitting material captured within the teeth of the gears to escape as the gears begin to mesh, each material feed channel extending between the pressure relief recess and the respective material reservoir pocket associated with the material feed channel.

14. The improved lubricating means for a gear pump according to claim 13, wherein each gear has a central hub portion from which the teeth of the gear extend radially outwardly at circumferential spacings to define material receiving spaces therebetween, the pressure relief recess is configured to be disposed axially adjacent the teeth and intervening material receiving spaces, and the material feed channels are disposed axially adjacent substantially only the respective hub portions of the gears.

15. The improved lubricating means for a gear pump according to claim 13, wherein the material feed channels are substantially linear and are generally aligned with one another.

16. The improved lubricating means for a gear pump according to claim 15, wherein the material feed channels are substantially semicircular in cross-section.

17. The improved lubricating means for a gear pump according to claim 14, wherein each material reservoir pocket is parabolic in shape and configured to taper narrowingly both axially and radially relative to the respective axial opening in the bearing means from an entrance end of the pocket communicating with the respective material feed channel.

* * * * *